United States Patent [19]

Ichihashi

[11] Patent Number: 4,694,270

[45] Date of Patent: Sep. 15, 1987

[54] ELECTROMAGNETIC PROPORTIONAL ACTUATOR

[75] Inventor: Koji Ichihashi, Higashimatsuyama, Japan

[73] Assignee: Diesel Kiki Co. Ltd., Tokyo, Japan

[21] Appl. No.: 846,878

[22] Filed: Apr. 1, 1986

[30] Foreign Application Priority Data

Apr. 9, 1985 [JP] Japan ..... 60-051657[U]

[51] Int. Cl.[4] ..... H01F 7/08

[52] U.S. Cl. ..... 335/260; 335/262

[58] Field of Search ..... 335/255, 257, 260, 261, 335/262

[56] References Cited

U.S. PATENT DOCUMENTS 3,331,042 7/1967 Erickson et al. ..... 335/262 X 4,468,647 8/1984 Gibas ..... 335/262

*Primary Examiner*—George Harris

*Attorney, Agent, or Firm*—Frishauf, Holtz, Goodman & Woodward

[57] ABSTRACT

An electromagnetic proportional actuator comprises a plunger axially movably received in a cylindrical housing. An actuating member has one end thereof abutting against or connected to one axial end of the plunger. The plunger is displaced in response to electric current passing through a solenoid wound around an outer peripheral surface of the housing. A tubular member formed of a non-magnetic material is disposed between an outer peripheral surface of the plunger and an inner peripheral surface of the housing in such a manner that the plunger is axially slidable within the tubular member, to prevent the plunger from being attracted to the inner peripheral surface of the housing.

11 Claims, 3 Drawing Figures

ELECTROMAGNETIC PROPORTIONAL ACTUATOR

BACKGROUND OF THE INVENTION

The present invention relates to an electromagnetic proportional actuator for use in an electromagnetic proportional control valve and the like.

It is required for an electromagnetic proportional actuator incorporated in an electromagnetic proportional control valve or the like, to accurately displace a plunger in response to exciting electric current passing through a solenoid, which plunger is for controlling pressure for opening the valve. In view of such requirement, as shown in FIG. 1, an electromagnetic proportinal actuator of the prior art in general comprises a housing 1 having formed therein a cylindrical portion 2. A plunger 4 is received in the cylindrical portion 2 and is fixed mounted on a shaft 3 formed of a non-magnetic material for movement therewith. The shaft 3 has opposite ends thereof axially slidably supported by a pair of bearings 5 and 6, respectively. A slight clearance is defined between an inner peripheral surface of the cylindrical portion 2 and an outer peripheral surface of the plunger 4 to prevent the plunger 4 from being electromagnetically attracted to the inner peripheral surface of the cylindrical portion 2. The plunger 4 is controlled in axial displacement in response to exciting electric current passing through a solenoid 7 wound around an outer peripheral surface of the cylindrical portion 2.

With the electromagneitc proportional actuator arranged as described above, however, such problems arise that since the actuator requires the shaft 3 and the bearings 5 and 6, the actuator has a great number of items or components and is complicated in structure. In addition, it is necessary to maintain tight machining tolerances of the bearings 5 and 6 supporting the opposite ends of the shaft 3, as well as those of the cylindrical portion 2 and the plunger 4, the latter being to maintain required accuracy of the clearance between the inner peripheral surface of the cylindrical portion 2 and the outer peripheral surface of the plunger 4. Therefore, the prior art actuator is inevitably expensive and large in size.

OBJECT AND SUMMARY OF THE INVENTION

An object of the invention is to provide an electromagnetic proportional actuator, which is simple in structure, low in manufacturing cost, and compact in size.

According to the present invention, there is provided an electromagnetic proportional actuator comprising:

- a housing;
- a plunger received in the housing and being movable axially thereof;
- an actuating member having one end thereof associated with one axial end face of the plunger;
- a solenoid wound around an outer peripheral surface of the housing;
- the plunger being displaceable in response to electric current passing through the solenoid; and
- a tubular member formed of a non-magnetic material and disposed between an outer peripheral surface of the plunger and an inner peripheral surface of the housing in a manner such that the plunger is axially slidable within the tubular member, whereby the plunger is prevented from being attracted to the inner peripheral surface of the housing.

The above and other objects, features and advantages of the invention will be more apparent from the ensuing detailed description taken in conjunction with the accompanying drawings.

DETAILED DESCRIPTION

An embodiment of the invention will now be described in detail with reference to the accompanying drawings.

Figure 1:
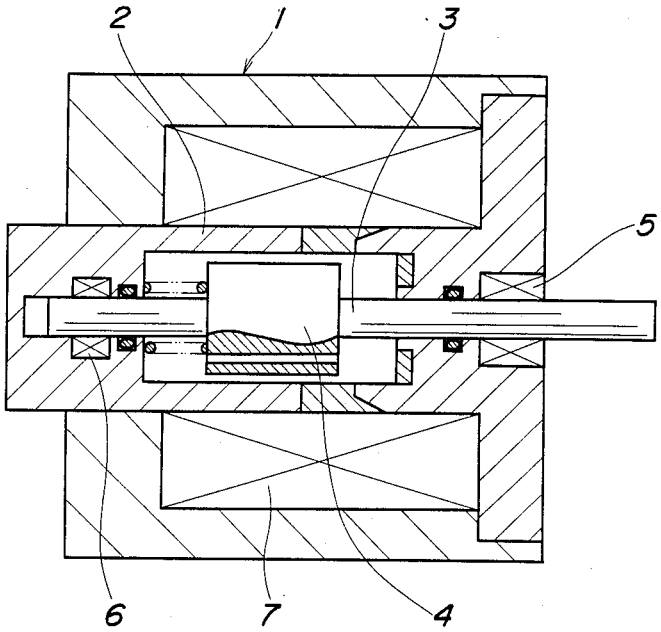
FIG. 1 PRIOR ART
FIG. 1 is a longitudinal cross-sectional view showing an electromagnetic proportional actuator of the prior art.
Figure 3:
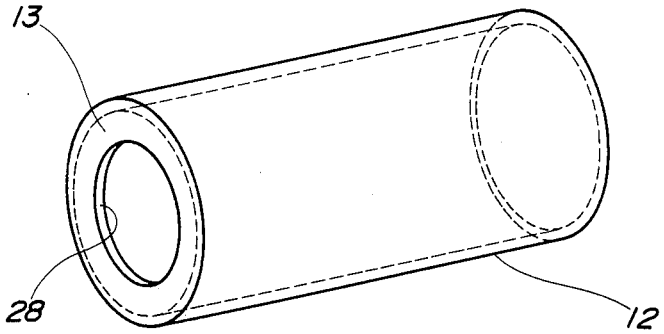
FIG. 3 is a perspective view showing a tubular member having an end wall illustrated in FIG. 2.
Figure 2:
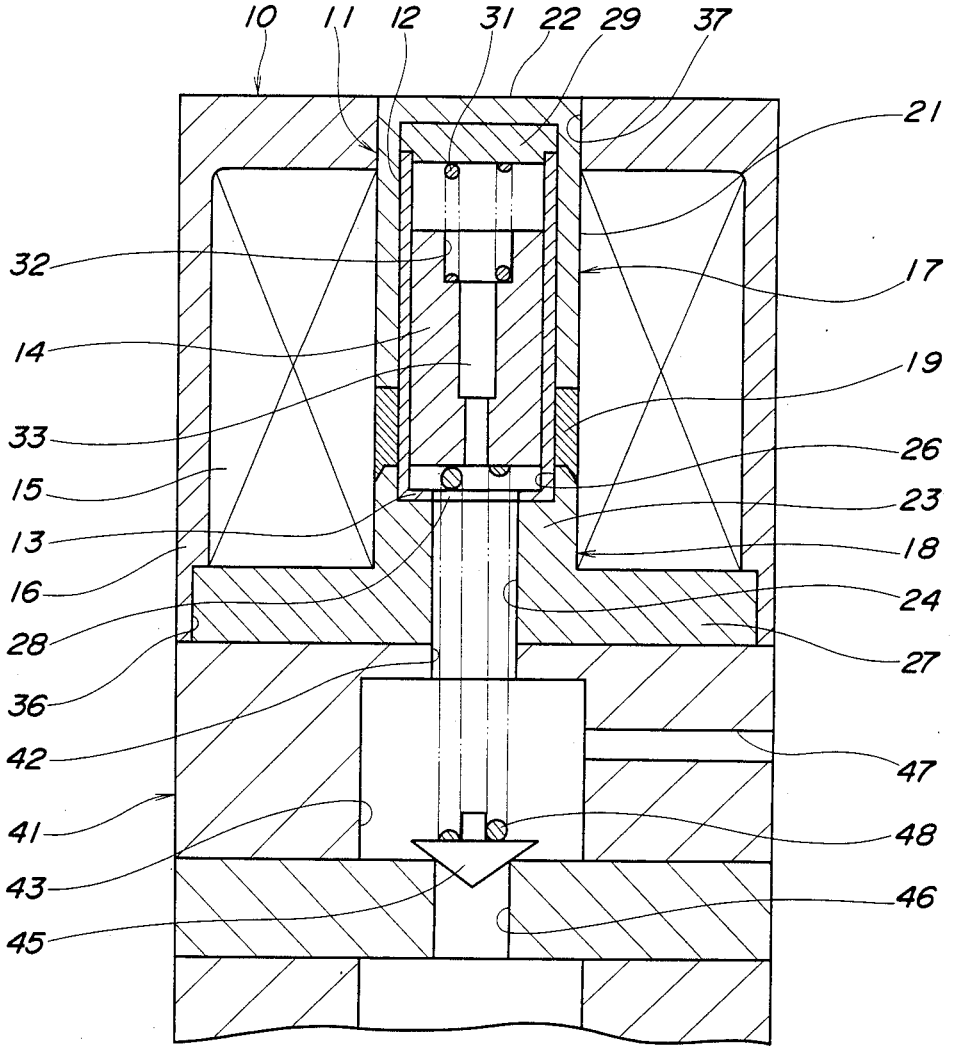
FIG. 2 is a longitudinal cross-sectional view showing an electromagnetic proportional actuator in accordance with an embodient of the present invention.

FIG. 2 illustrates an electromagnetic proportional control valve having incorporated therein an electromagnetic proportional actuator, generally designated by reference numberal 10, in accordance with the embodiment of the present invention. The actuator 10 comprises a cylindrical housing 11, a tubular member 12 having at one axial end thereof an end wall 13 and received in the housing 11 in concentric relation thereto, a plunger 14 received in the tubular member 12 in concentric relation thereto, a solenoid 15 wound around an outer peripheral wall of the housing 11, and a generally cup-shaped cover 16 having received therein the housing 11 and the solenoid 15.

The housing 11 is comprised of a first yoke 17, a second yoke 18, and an annular member 19 disposed therebetween. Specifically, the first yoke 17 is formed of a magnetic material and comprises a cylindrical wall 21, and an integral end wall 22 closing one axial end of the cylindrical wall 21. The second yoke 18 comprises a cylindrical body 23 having defined therein a central through bore 24 extending in coaxial relation to the cylindrical wall 21 of the yoke 17. A circular recess 26 if formed in one axial end face of the cylindrical body 23 in coaxial relation to the through bore 24. A flange 27 is integrally formed on the other axial end of the cylindrical body 23 and extends therefrom radially outwardly. The cylindrical wall 21 of the yoke 17 has an inner peripheral surface of a diameter equal to that of the circular recess 26 in the yoke 18 and an outer peripheral surface of a diameter equal to that of the cylindrical body 23 of the yoke 18. The annular member 19 is disposed between the one axial end of the cylindrical body 23 of the yoke 18 and the other axial open end of the cylindrical wall 21 of the yoke 17 in coaxial relation thereto.

The annular member 19 is formed of a non-magnetic material such as brass, for example, and has outer and inner diameters set to values equal to outer and inner diameters of the cylindrical wall 21 of the yoke 17, respectively. The annular member 19 interrupts or breaks the electromagnetic circuit between the yokes 17 and 18 to cause the magnetic flux to flow along a path extending from the yoke 18 to the yoke 17 through the plunger 14 when the solenoid 15 is energized. it will be clear from the above description that the cylindrical body 23 of the yoke, the annular member 19, and the yoke 17 form the cylindrical housing 11 in which the tubular member 12 and the plunger 14 are received in concentric relation.

As shown in FIG. 2, the tubular member 12 is manufactured from a pipe member of a non-magnetic metallic material such as brass such that one axial end of the pipe member is worked by press forming so as to form the end wall 13 having therein a central hole 28. Alternatively, the end wall 13 may be fabricated in a separate piece from the pipe member of the tubular member 12, and fitted into and brazed to one end of the pipe member. According to this alternative method the roundness of one end of the pipe member can be enchanced. Referring again to FIG. 2, the tubular member 12 is fitted in the yoke 17 and has a wall thickness set to a value of the order of a clearance between the inner peripheral surface of the cylindrical wall 21 of the yoke 17 and the outer peripheral surface of the plunger 14. The hole 28 in the end wall 13 of the tubular member 12 is axially aligned with the through bore 24 in the yoke 18 and has the same diameter as through bore 24. The end wall 13 of the tubular member 12 is fitted in the circular recess 26 in the yoke 18. A disc-like stopper 29 formed of a non-magnetic material is disposed between the other axial open end of the tubular member 12 and an inner surface of the end wall 22 of the yoke 17, so that the stopper 29 serves as a seat for a coil spring 31 to be described later, and also serves to maintain required roundness of the other axial open end of the tubular member 12.

The plunger 14 is fitted in the tubular member 12 and has an outer diameter set to a value slightly less than an inner diameter of the tubular member 12 such that the plunger 14 is slidable within the tubular member 12 axially thereof. The plunger 14 has formed in one axial end thereof a circular recess 32. An axially extending bore 33, which is smaller in diameter than the circular recess 32, is formed in the plunger 14 and has one axial end opening in the bottom surface of the circular recess 32. The coil spring 31 is disposed between an end face of the stopper 29 and the bottom surface of the circular recess 32 which faces to the end face of the stopper 29.

With the arrangement described above, the outer peripheral surface of the plunger 14 faces to the inner peripheral surface of the cylindrical wall 21 of the yoke 17 and the peripheral wall surface of the circular recess 26 in the yoke 18, through the peripheral wall of the tubular member 12, so that the plunger 14 is prevented from being magnetically attracted to the yokes 17 and 18. In addition, the tubular member 12 also has a bearing function of supporting the plunger 14 per se.

The solenoid 15 is wound around the cylindrical housing 11, and the solenoid 15 and the housing 11 are received within the generally cup-shaped cover 16 which is formed of a magnetic material. The flange 27 of the yoke 18 is fitted in a circular recess 36 formed in the open end face 36 of the cover 16, and the closed one axial end of the yoke 17 is fitted in a through bore 37 formed in the bottom wall of the cover 16, to thereby form an outside magnetic circuit.

A housing 41 forming a part of the control valve is rigidly secured to an end face of the flange 27 of the yoke 18. The housing 41 has formed therein a bore 42 aligned with the through bore 24 in the yoke 18, a bore 43 having therein a valve member or valve body 45 and in communication with the bore 42 in coaxial relation thereto and disposed to be opened and closed by the valve member 45, and a radial drain hole 47 in communication with the bore 43. The valve member 45 is disposed within the bore 43 and is operative to open and close the valve port 46. An elongated actuating member such as a coil spring 48 is arranged between an end face of the valve member 45 and an axial end face of the plunge 14 facing thereto. Specifically, the coil spring 48 has one axial end thereof abutting against the axial end face of the plunger 14 and the other axial end abutting against the end face of the valve member 45 and extends in coaxial relation to the plunger 14 through the bore 28 in the end wall 13 of the tubular member 12, the through bore 24 in the yoke 18 and the bore 42 in the housing 41, to thereby resiliently bias the valve member 45 in a direction in which it closes the valve port 46.

The plunger 14 is attracted in response to exciting electric current supplied to the solenoid 15 so that the plunger 14 slides within the tubular member 12 away from the end wall 22 of the yoke 17 toward the yoke 18 to compress the coil spring 48 accordingly, that is, drive the coil spring 48, i.e. pressure required to open the valve.

With the arrangement of the invention described above, the actuator is very simplified in construction and reduced in the number of items or components as compared with the electromagnetic porportional actuator of the prior art in which a plunger fixedly mounted on a shaft is utilized. Thus, the actuator of the present invention has such advantages that it is possible to reduce the manufacturing cost and to make the structure compact in size.

What is claimed is:

1. An electromagnetic proportional actuator comprising:

a housing;

a plunger received in said housing and being movable axially thereof;

an actuating member having one end thereof associated with one axial end face of said plunger, said actuating member comprising a coil spring having one end thereof abutting against said one axial end face of said plunger;

a solenoid wound around an outer peripheral surface of said housing;

said plunger being axially displaceable in response to electric current passing through said solenoid to drive said actuating member; and a tubular member formed of a non-magnetic material and disposed between an outer peripheral surface of said plunger and an inner peripheral surface of said housing such that said plunger is axially slidable within said tubular member, whereby said plunger is prevented from being attracted to the inner peripheral surface of said housing.

2. An electromagnetic proportional actuator as defined in claim 1, wherein said tubular member has at one axial end thereof and end wall having therein a bore, said actuating member extending through said bore.

3. An electromagnetic proportional actuator as defined in claim 2, wherein said housing comprises a first cylindrical member formed of a magnetic material and having one axial end closed and the other axial end open, a second cylindrical member formed of a magnetic first cylindrical member and having one axial end thereof adjacent the other axial open end of said first cylindrical member, and an annular member formed of a non-magnetic material and disposed between the other open axial end of said first cylindrical member and the one axial end of said second cylindrical member in coaxial relation thereto, said coil spring extending through said bore in said end wall of said tubular member and said second cylindrical member.

4. An electromagnetic proportional actuator as defined in claim 3, wherein said tubular member has the other axial end open;

and further comprising:

a disc-like stopper formed of a non-magnetic material and fitted in the other axial end of said tubular member; and spring means disposed between said stopper and the other axial end face of said plunger to resiliently bias same toward said end wall of said tubular member.

5. An electromagnetic proportional actuator as defined in claim 4, wherein said second cylindrical member has a circular recess formed in said one axial end thereof, said one axial end of said tubular member being fitted in said circular recess.

6. An electromagnetic proportional actuator comprising:

a housing;

a plunger received in said housing and being movable axially thereof;

an elongated actuating member extending substantially in coaxial relation to said plunger, said elongated actuating member having one end thereof associated with one axial end face of said plunger, said actuating member comprising a coil spring having one end thereof abutting against said one axial end face of said plunger;

a solenoid wound around an outer peripheral surface of said housing;

said plunger being axially displaceable in response to electric current passing through said solenoid to drive said actuating member; and a tubular member formed of a non-magnetic material and disposed between an outer peripheral surface of said plunger and an inner peripheral surface of said housing such that said plunger is axially slidable within said tubular member, whereby said plunger is prevented from being attracted to the inner peripheral surface of said housing;

said tubular member having at one axial end thereof an end wall having therein a bore, said actuating member extending through said bore.

7. An electromagnetic proportional actuator as defined in claim 6, wherein said housing comprises a first cylindrical member formed of a magnetic material and having one axial end closed and the other axial end open, a second cylindrical member formed of a magnetic material and disposed in coaxial relation to said first cylindrical member and having one axial end thereof adjacent the other axial open end of said first cylindrical member, and an annular member formed of a non-magnetic material and disposed between the other open axial end of said first cylindrical member and the one axial end of said second cylindrical member in coaxial relation thereto, said coil spring extending through said bore in said end wall of said tubular member and said second cylindrical member.

8. An electromagnetic proportional actuator as defined in claim 7, wherein said tubular member has the other axial end open;

and further comprising:

a disc-like stopper formed of a non-magnetic material and fitted in the other axial end of said tubular member; and spring means disposed between said stopper and the other axial end face of said plunger to resiliently bias same toward said end wall of said tubular member.

9. An electromagnetic proportional actuator as defined in claim 8, wherein said second cylindrical member has a circular recess formed in said one axial end thereof, said one axial end of said tubular member being fitted in said circular recess.

10. An electromagnetic proportional actuator as claimed in claim 6, wherein said plunger has an axially extending bore formed therethrough.

11. An electromagnetic proportional actuator as claimed in claim 1, wherein said plunger has an axially extending bore formed therethrough.

* * * * *

UNITED STATES PATENT AND TRADEMARK OFFICE

CERTIFICATE OF CORRECTION

PATENT NO. : 4,694,270

DATED : September 15, 1987

INVENTOR(S) : ICHIHASHI

It is certified that error appears in the above-identified patent and that said Letters Patent is hereby corrected as shown below:

Column 4, Claim 3, lines 5 and 6, "magnetic first cylindrical" should read -- magnetic material and disposed in coaxial relation to said first cylindrical --.

Signed and Sealed this

First Day of March, 1988

*Attest:*

*Attesting Officer*

DONALD J. QUIGG

*Commissioner of Patents and Trademarks*